United States Patent [19]

Eglise et al.

[11] Patent Number: 4,597,506

[45] Date of Patent: Jul. 1, 1986

[54] BEVERAGE DISPENSING MACHINE

[75] Inventors: David Eglise, Windsor; Edward C. Horton, Maidenhead, both of England

[73] Assignee: Mars Limited, London, England

[21] Appl. No.: 484,158

[22] Filed: Apr. 12, 1983

[30] Foreign Application Priority Data

Apr. 15, 1982 [GB] United Kingdom ..... 8210923

[51] Int. Cl.[4] ..... G07F 13/10

[52] U.S. Cl. ..... 221/6; 221/21; 221/96; 364/465

[58] Field of Search ..... 221/2, 6, 8, 13, 14, 221/21, 96; 194/1 N, 10, 13; 364/464, 465, 479; 340/365 VL

[56] References Cited

U.S. PATENT DOCUMENTS 4,202,038 5/1980 Petersson ..... 340/365 VL X
4,231,105 10/1980 Schuller et al. ..... 194/10 X
4,328,539 5/1982 Heeger ..... 364/479 X

FOREIGN PATENT DOCUMENTS 2067311 7/1981 United Kingdom ..... 364/479

*Primary Examiner*—F. J. Bartuska
*Attorney, Agent, or Firm*—Curtis, Morris & Safford

[57] ABSTRACT

A beverage dispensing machine provided with the ability to alter machine characteristics and to diagnose machine faults without additional fault indicating displays through use of beverage select buttons normally used to select a variety of beverage selections offered by the machine.

24 Claims, 2 Drawing Figures

BEVERAGE DISPENSING MACHINE

Figure 1:
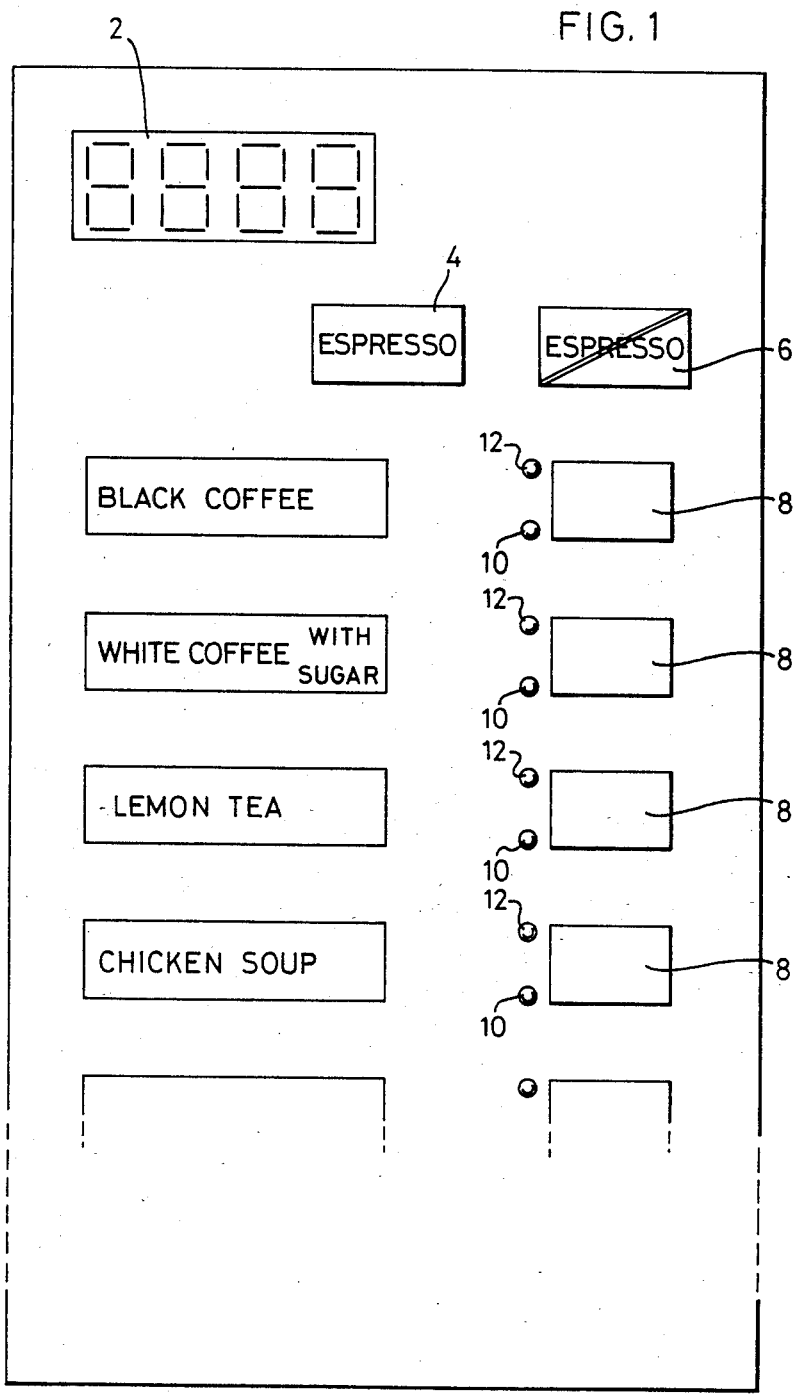

This invention relates to beverage dispensing machines, especially to those of the "In-Cup" vending type.

"In-Cup" beverage vending machines are a well-established means for obtaining beverages conveniently. Typical are those sold under the trade mark "Klix".

Such machines combine mechanical and electrical operations such as cup-separating, water dispensing, operation of the coin mechanism, and control of the beverage selection. They are becoming increasingly sophisticated in, for instance, the options offered to the user in the form of beverage range selected, or vend price selection, in rendering the coin mechanism foolproof, and in fault diagnosis. The advent of microelectronics has assisted with such sophistication.

Various different approaches have been made to the installation of microprocessors in vending machines, but these have mostly employed separate keyboards and displays for entering changes to the machine characteristics (e.g. price setting). Such keyboards are typically installed within the machine to make them inaccessible to the normal user.

We have now developed a beverage dispensing machine having a number of improved features. Important features include the ability to alter machine characteristics by means of the usual beverage select buttons and the ability to diagnose machine faults without the need for additional fault indicating displays. The visual displays normally employed to impart information to the user during beverage selection have a multiplexed role in that they impart different types of information when the machine characteristics such as quoted are changed.

According to the invention there is provided a beverage dispensing machine having a beverage dispensing mode and at least one machine function mode, a plurality of user selection keys each enabling the user to select a beverage from a range thereof, a corresponding plurality of first visual display means, one each associated with each user selection key and for displaying, during the dispensing mode, whether or not a selected beverage is available for dispensation, and second visual display means for indicating credit functions to the user during the dispensing mode, and wherein, when said at least one function mode is enabled, said keys and said first and second display means combining to enable an operator to view and change machine characteristics and functions.

Preferably the machine is of the "In-Cup" type wherein each of the user selection keys is a depressible button associated with the dispensing of one particular beverage from the machine.

Preferably the first visual display means consists of one or two indicator lamps which, in the beverage dispensing mode, indicate that the beverage is available for selection by means of its associated key, or that the stack of cups held in the machine for dispensing via the key is exhausted. Such indicator lamps are often termed "beverage select" or "stack empty" indicators.

Figure 2:
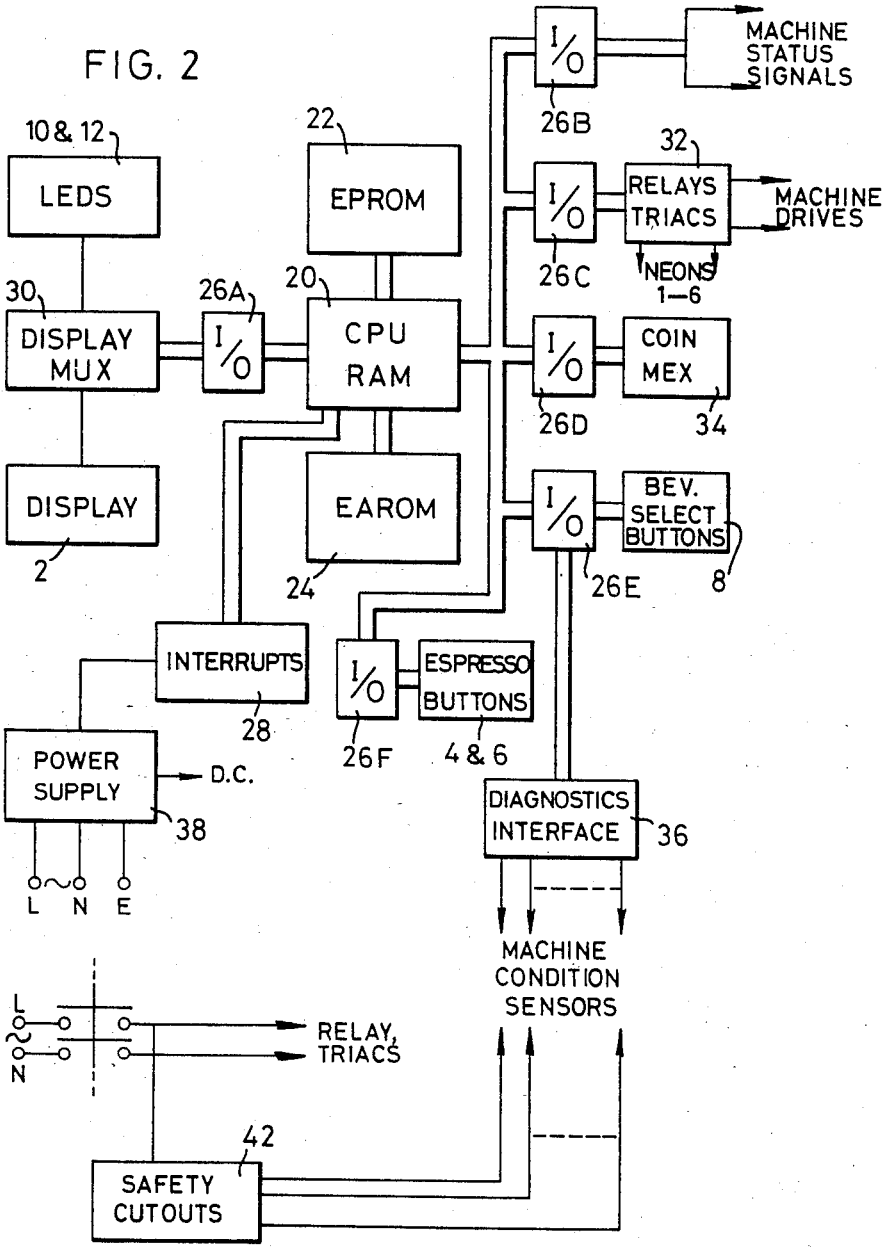

Preferred features of the invention will now be described with reference to the accompanying drawings, given by way of example, wherein:

FIG. 1 illustrates the front display panel and user selection buttons of an "In-Cup" beverage dispensing machine according to the invention, and FIG. 2 is a schematic electrical diagram of the circuits employed in this machine.

Referring to FIG. 1, the beverage dispensing machine is essentially an improved version of the well-known Klix 3000 or 5000 "In-Cup" beverage vending machine, and thus a detailed description of its complete operation is not essential. The display panel illustrated in FIG. 1 includes a four character, seven segment alphanumeric display 2 normally employed for indicating to the user the credit available to him once he has inserted coins to the machine. An espresso select button 4 and nonespresso (i.e. cancel espresso) button 6, together with a plurality of beverage select buttons 8 are also provided. Each beverage select button 8 has adjacent thereto an l.e.d. 10 which is green when energised and an l.e.d. 12 which is red when energised. In normal vending operation the green l.e.d.'s indicate that the particular beverage is available for vending, whereas the red l.e.d.'s indicate that the particular beverage is sold out (i.e. the stack of cups is exhausted).

As well as being employed in the normal vending operation, the components thus-described may be employed for various control functions associated with the machine. These control modes cannot be entered until the front door of the machine, on which the panel is mounted, is open. In such a circumstance the espresso select button 4 acts as a function mode control key, dictating the function of the display 2, beverage select buttons 8, and l.e.d.'s 10 and 12. Each successive depression of button 4 provides these latter components with a different function. These successive functions are:

| Depression of button 4 | Function Mode Selected |
|---|---|
| First | Beverage price setting |
| Second | Beverage option setting |
| Third | Coin Inventory |
| Fourth | Fault Diagnosis |
| Fifth | Water dispense time selection |

Thus to enter the Fault diagnosis mode, for example, the espresso select button 4 must be depressed four times whilst the front door of the machine is open. The various function modes will now be described.

BEVERAGE PRICE SETTING

This enables the vend price of each selectable beverage to be altered.

Upon entry into this function mode (one depression of espresso select button 4), the left-most character of display 2 illuminates as a "P" to indicate the price setting function selected. The operator may change the price of any beverage by first depressing the appropriate beverage select button 8. Its adjacent green l.e.d. 10 illuminates, and the currently set price for the beverage appears in the three right-most characters of display 2. A further depression of this particular beverage select button 8 then causes the vend price to increment slowly until depression is released. A second depression causes the vend price to decrement slowly until depression is released. Thus, one or two depressions of the button may be employed to alter the vend price up or down as desired. The procedure may then be repeated for any other beverage by depressing that particular beverage select button 8 and proceeding through the cycle just described.

BEVERAGE OPTION SETTING

The second depression of espresso select button 4 enters this mode. The left-most character of display 2 indicates "0".

For the purposes of this example these might be: hot water (no accessories), cold water (no accessories), hot water and an accessory such as sugar, hot water and an accessory such as salt, hot water and an accessory such as milk. These may be changed for any beverage during this function mode.

To effect such a change, the given beverage select button 8 is depressed and its adjacent green l.e.d. 10 illuminates. The right-most character of display 2 is employed to indicate the various options: "0" for hot water, "1" for cold water, "2" for carbonated water, and so forth.

COIN INVENTORY

This enables the coins held in the coin change tubes to be dispensed. Assume in this example that three different coins (1p, 2p, 5p) may be dispensed as change.

This function mode is entered with the third depression of espresso select button 4. Immediately, the left-most character of display 2 illuminates as a "C" and the top three green l.e.d.'s 10 illuminate. Upon depressing the topmost beverage select button 8 (adjacent the top illuminated green l.e.d. 10) the lowest value change coins are dispensed for as long as the button remains depressed (i.e. the 1p change tube is emptied). The second to topmost beverage select button 8 dispenses the 2p change coins for as long as it is depressed, and the third to topmost button 8 dispenses the 5p change coins for as long as it is depressed.

FAULT DIAGNOSIS

Upon entry into this mode (fourth depression of espresso select button 4) any of a number of selected faults which may have occurred in the machine since the last time the front door was opened are indicated. The faults detected could be for any of a number of reasons: for example, faults in the cup dispensing operation, in the water preparation/dispensing, or in the operation of the coin mechanism. The faults might be mechanical or electrical, and detected by the machine electronics by appropriate sensors such as microswitches. In this example 24 separate possible faults are displayed. Specific single examples are cup carousel rotation problem, slug coin received, thermostat fault, cup jam.

The 24 possible faults are grouped into three pages of eight. Upon depression of the topmost beverage select button 8, diagnosis of the first page of possible faults is achieved. The l.e.d. displays associated with the top eight beverage select buttons 8 are employed to indicate whether the diagnosis has indicated whether any of these faults exist. The presence of a given fault on page 1 will cause selected green or red l.e.d.'s 10 and 12 to illuminate. In order to identify the fault conditions to be ascribed to these three pages of 8 faults and the meaning to be ascribed to any red or green l.e.d.'s illuminated, the operator is provided with a separate description to decode the faults and conditions displayed. The operator can thus immediately identify which faults exist from the position and colour of the illuminated l.e.d.'s.

Depression of the second and third to topmost beverage select buttons 8 causes diagnosis of the second and third pages of faults, respectively, in an exactly similar fashion.

During the Fault diagnosis mode, the left-most character of display 2 indicates a "d", whereas the rightmost character indicates "1", "2" or "3" depending upon which page of faults is being diagnosed.

WATER DISPENSE TIME SELECTION

Upon the fifth depression of espresso select button 4 this mode is entered. It is displayed on the left-most character of display 2 as a "t". It enables the operator to vary the time period over which the water is dispensed to the cup, for any given beverage, to be altered. Any period between 0 and 5 seconds may be selected in 50 millisecond steps.

To effect such a change, the given beverage select button 8 is depressed and its adjacent green l.e.d. 10 illuminates. The right-most characters of display 2 indicate the current water dispense period as a percentage of 5 seconds. Depression, and holding down of this button 8 causes the percentage to increment slowly until released, whereas a second depression causes a slow decrement until the button is released. This may be repeated for any of the beverages via their appropriate select buttons 8.

The function mode capability of the components described is obtained by opening the front door of the machine: door switches disable the normal vending operation. The function mode capability is cancelled and normal vending operation returns when the door is closed.

With a carousel-type machine, where stacks of cups are indexed past a cup separating station, the beverage dispensed by any given stack in the carousel may be changed simply by inserting the new stack in the carousel and changing the label on the front of the machine, adjacent the beverage select button 8 for that stack. It may then be necessary to alter the vend price, beverage option setting, and water dispense time appropriately as described above.

FIG. 2 is a schematic representation of the electrical circuits employed in the dispensing machine just described. It includes a microprocessor 20 comprising a central processing unit with an integral, on-chip RAM, which microprocessor in this example is an Intel type 8039-6. Linked to microprocessor 20 by the usual buses are an EPROM 22, an EAROM 24, a plurality of input/output ports and expanders 26 A to F, and an interrupt circuit 28.

Input/output port 26A is linked to a display multiplexer 30 which drives the l.e.d.'s 10, 12 and the four digit seven segment display 2 shown in FIG. 1. A second input/output port 26B is linked to a plurality of machine status signals provided from position switches associated with various machine functions, to indicate to the circuitry, for example, the position of the cup carousel, or whether any stack of cups is empty. Input/output port 26C is linked to a plurality of relays, optical isolators and triac drives 32 which in turn control six neons and a number of machine drives. These neons and machine drives are such as on the known Klix 3000 or 5000 beverage vending machine. The machine drives actuate the various valves, pumps and motors within the machine as required to dispense a beverage, e.g. the cup splitting motor, the cold water pump, the carousel rotation motor. The neons 1–6 are displayed to the user of the machine to indicate various messages e.g. machine ready and can dispense change, or espresso drinks selected.

Input/output port 26D is linked to a coin mechanism 34, whereas port 26E is linked to the beverage select buttons 8 (of FIG. 1) and to a diagnostics interface 36. The latter comprises an 8 to 1 multiplexer together with opto-isolators and which are linked to eight machine condition sensors: cold and hot water drip trays, hot and cold water levels low and high and over-temperature cut-outs for the water heater. These sensors provide active signals in the event of a machine fault being diagnosed. Input/output port 26F is linked to the espresso select and cancel buttons 4, 6 (of FIG. 1).

The mains power supply drives a machine power supply 38 which not only provides the necessary D.C. voltage levels for driving the various electronic circuits, but is also connected to the interrupted circuit 28. The latter senses the voltages at the power supply and, in the event of an abnormally low supply (e.g. power failure), provides an interrupt to the CPU normal operation to enable essential machine conditions to be dumped rapidly into the non-volatile EAROM 24. In this manner, upon restoration of power, the machine can quickly return to its original condition without the need for resetting of machine conditions such as beverage prices, water dispense times etc.

The mains power supply is also employed to power the machine drives and the six neons via the relays, triacs 32, but only if the front door of the machine is closed, as controlled by door switches 40.

Certain of the machine condition sensors provide diagnosis of faults which make it desirable to disconnect the mains power supply, and this is shown schematically by safety cutouts 42.

In a further version of the apparatus described with reference to FIGS. 1 and 2, the red and green l.e.d.'s 10 and 12 are replaced by three-digit seven-segment alphanumeric displays. In the beverage dispensing (vending) mode these displays (termed "beverage price displays" to avoid confusion with the credit display 2) indicate the current price of the beverage which may be obtained by actuation of the associated beverage select button 8. If the particular beverage is not available, e.g. if the stack of cups is exhausted, then the associated beverage price display indicates three dashes.

The displays are also employed during the various control modes to indicate machine functions and characteristics alphanumerically. When the machine door is opened, the machine automatically defaults from the beverage dispensing mode to the fault diagnosis mode. Any faults on the machine since the last time the door was opened are displayed in the beverage price displays as three digit alphanumeric codes informative to the mechanic. If more faults exist than the number of beverage price displays then the faults are displayed in successive groups. The last fault is indicated by the next display indicating three dashes rather than a three digit fault code.

Similarly, in other control modes, characteristics and functions relative to any given beverage may be viewed (and changed if appropriate) with reference to information held in the relevant beverage price display. Thus, the price of any beverage is viewed and changed using the relevant beverage price display rather than using the credit display 2.

The machine is also in two versions. In one, the cancel espresso button is employed to select control modes as described above. In a further version, in which an espresso-type drink option is not provided, the Key(s) for assisting in enabling the various machine control mode is/are provided inside the machine, in accessible to the normal user and having no function during the beverage dispensing mode.

The following is a machine code listing of the program employed in the above-described microprocessor. The listing is in Intel hexadecimal format: the first two characters indicate the number of characters of instructions at each address (16 decimal characters), the next four indicate the address, the next two are unused (00 hex), then follows sixteen two-hex character instructions, and finally a two character check sum.

```
:10000000040900048400000049589FF8AFF2300B8D6
:100010007FA0E811B81F805CE57483E58AE0945F31
:10002000230F8D230F8F230F8F8AD09ADF230F8FFD
:10003000230F8F86332396E514A7E58633E514B3A3
:10004000E5963B05E534C7E5BB24BA00B820F534AA
:10005000905A01A18ED4E27F5D400E5F514D2558B
:10006000F55475E5E5B4DFE5046AE59450E5F5344B
:10007000000E5F57400E5E5F400E5F5D44CE5E5347C
:10008000F3F5046A2308D7E5A5153565168E1494A3
:100090003 4C704099 3D5AC3565FDC6A507ADC6A523
:1000A00023A4625525FC93D53565ADC6B223A46261
:1000B000552593D5FD9314A714B396B8835307031E
:1000C000C3A39301020408102040 80F9976769A831
:1000D000F02912D72904D92947530F83F953F87708
:1000E000777768A8F95307E514BDE5A950C6F12351
:1000F0000183F95307034AA9F14380A19300000048
:10010000 85C60495F953F877777768A8F95307E51A
:100110001 4BDE5A9B61A3750241B40A093D5B83CAE
:10012000F53460E5C5AAF9A8BC00BD00B91097FA8B
:10013000F7AAFBF7ABFC7C57ACFD7D57ADF641E968
:100140002EFDA9FCD5B83CE53478E5C583B8092A6D
```

```
:10015000376137E65661A72AF72AF7E850672A83FE
:10016000AAF82FA9B807FFC67497F7AFE671F0A1F8
:1001700019C82466F9AFFA93AAF82FA9B800FFC6E8
:10018000BC9767AFE689C9F1A018247EF9AFFA937E
:10019000D5B817E53460E5C534D8890899EF9906E4
:1001A00099FEBA0E0099F734EF9700890899FB344D
:1001B000EF99F756B72489A700F7EAA934C8D5B81C
:1001C00017E53478E5C58335890889073 4EF99F751
:1001D00034F234F189082583352 72ABC0AB9043 45E
:1001E0004D3799F95447BC0AFA3700890854470 03B
:1001F000000008300000093000000830000000000076
:10020000D5B81FE53460E5C534D889088905FBE712
:1002100034F199F7BA0E34F1EC0A890899FAE7F249
:10022000259 9EF442989104429 99F734EFEA1A896E
:10023000088904 1A34F099F734F1EC2D34C8D5B894
:100240001FE53478E5C5836CC64E8910445299EF9A
:10025000445299F7EC57830734F0890800444883E7
:10026000B908F98AB09ABF373E0D37530FB802204C
:1002700047203018204720 30F99767A99462373E0B
:10028000FA4B968823604 49DB8FF97FB67ABFA67EB
:10029000AA18E68AFB4AC69C23A0449DF883D5B8D9
:1002A0003FE53460E5C5E55460E5F2C2ACFD0A2324
:1002B000940796B1E55460E5DCC6BF23A044C2EDC7
:1002C000AFFCD5B83FE53478E5C5838A709A7F3DA9
:1002D0002306E514B6E58A709A7F230F8D838AD0B2
:1002E0009ADF23028E23B09023FD9EB94AB808F10D
:1002F000D3809119E8EF830000000000000000000A7
:10030000A3B3E7E7680309A39340202020412020 2E
:1003100020422020204320202044202020452020 4F
:1003200020462020204620202047202020472020 33
:10033000202020202020202020202020202020 20 8D
:10034000202020202020202020080102040506 0172
:10035000010140414242434142420302010102 0580
:100360000A140000000C0606000A28C87D7B306DC8
:10037000753657 5F707F777E1F4B3D4F4E00EE9D69
:10038000BD8FB94AB808B10019F887F554DFE59C
:100390008353 1F036DE329034A29A193D5B83FE591
:1003A0003460E5C596B4B803F8034AA9B100E8A8D9
:1003B000884AB07B64D5AABD03235BE3AC85235C5C
:1003C000E3A827A96A29130029E8C4E59420F5FCDD
:1003D000A9E514F2E5E554DEE5D5B83FE53478E566
:1003E000C593F55400E5375304AAF853034A832311
:1003F00064E514B6E5278300000000000000000005B
:10040000D5B83FE53460E5C5BD028C0085B900E55F
:10041000942 0E5E554DEE5D5B83FE53478E5C593AD
:10042000E5341DE5E6292399A9AAF9AB1DCDFDA95F
:10043000B802E514CBE5A9FC376DE646B646F99659
:100440045B910844695FD29E57491E51DED2D8390
:10045000B957F1379292E57483E5F51439E5969230
:10046000A5B5E58493B85B230440A0E57483E576E5
:100470081B924BA00B820F0A8E55400E51A18E9B8
:100480077B848F0E5749CE5F55475E5B95723EF66
:10049000 51A183237EE594D6E5BFFFB50FBD20BCEE
:1004A000808595E5D400E5E574E2E5C6A312B2E5E2
:1004B000846 5E584B5237FE594D6E5BFFFB50FBD17
```

```
:1004C00030BC0885E5D400E5E574E2E5C6C412D38A
:1004D000E58465E5A400B94AB808B10019E8DAB95D
:1004E0004DE3A1E554DEE583000000000000000BC
:1004F000000000000000000000000000000000000FC
:10050000238 0E594D6E5B84EB007E554DEE5F55422
:100510009EE5A903FDF62FF90344A8F0C62A07A01B
:10052000235D69E3B819E534F7E5F9F5146AE5E503
:100530074E2E5C60E123AE58465E5443D2381E543
:100540094D6E5BFFFE5549EE5A903FDF66AF9DF01
:10055000C66AF9AF0358A8F0B850A037C8C8A0C8F9
:10056000C8236E6FE3A0E554DEE5E574E2E5C64519
:100570001275E58465E5A4782382E594D6E5BFFF8E
:10058000BE03BD40BC6585E5D400E5E574E2E5C683
:1005900087129 6E58465E58493E514B3E596A32375
:1005A00010A4DE0947773753019699235207 96AD79
:1005B000094777375301969 9B90923A40796BC09D0
:1005C00047773753016 7FB67A8E9BA23520796CDF2
:1005D000094777375301C6DC2300A4DE2308838A4A
:1005E000D09ADF23088F2302E514B6E58AD09ADF7C
:1005F00023F79F83000000000000000000000000BF
:10060000E5549EE5A9FE3769F672F9DFC636F9AF03
:1006100027B84FA0C8A037E53400E5FD6FA8F0B6B5
:1006200027E59400E5C42BE5749CE5E5549EE5DFF1
:10063000C62BBB01C472A5FD6FA8F06BA0FC376090
:1006400037C647E648FC07A0F0B651E59400E5C47C
:1006500055E5749CE5234BE514A7E5E514B3E5C621
:1006600072E5549EE5D26DF25BDFC65B83FB370318
:10067000 01AB83D5B81C553460E5C5BA008AD09AD1
:10068000DF23FB9E2301E514A7E5E5B499E5AB372D
:10069000929F8AD09ADF23048FE5B4DFE5C4D5FAA8
:1006A000C6B8FB96A9F8DCC6CAFAD30496B8B958FE
:1006B000231041A1BB80C4CA14F8AC8AD09ADF23A8
:1006C000048E23DE000796C4C47D23C50796CC8A1A
:1006D000D09ADF23048E23FE0000000796D8FBD5B6
:1006E000B81CE53478E5C583000000000000000078
:1006F000000000000000000000000000000000000FA
:10070000B900B80809E7E75301C60C192309079691
:10071000EE804F9C6C1D3089600E5D473E596C186
:10072000F8AF53E3D342962C2304E439FF5383D329
:100730000096 3EFF7747375303AEB816E452FF5397
:10074000 83D301966BFF7747375303AF0344A8105A
:10075000B817FE035DE3ADE534F7E5FFF5140 0E5FA
:10076000B848FD60A0E5749CE5E4C1FF53EFD36E8B
:100770009 67AB857230440A0E4C1FF53EFD36B9699
:100780097B858232040A0B8182301E534F7F52393
:100790002E554CBE5E4C1FF53EFD36F96A6B858FA
:1007A000234040A0E4C1FF53EFD36796B5B8582368
:1007B0008040A0E4C1FF53E3D32396C1F8F5140 0B1
:1007C000E583B857230850 96E3F04308A0B848E0F3
:1007D000E5749CE58AD09ADF23F79EB80AB9DCE974
:1007E000DFE8DD830000000000000000000000000E2
:1007F000000000000000000000000000000000000F9
:10080000D5B80CE53460F5C57777AAB8582380508 1
:10081000C6140430B903C9234469A8236569E3AB4E
:100820002A672AF62BFB376037E62DFBA019E9165D
```

```
:10083000D5B80CE53478F5C583B857230850C66998
:10084000F053F7A08AE09AEF230F8F8AD09ADF2324
:10085000088EF514AAF5236EE514A7F509E7E7530A
:10086000019669E514B3F5965C83E514BDF58AD06D
:10087000 9ADF3753078F43F89F2369E3E514B6F5F2
:10088000 8AD09ADF23078F236AE3E514B6F5F514BF
:10089000 93F5838AD09ADF23F79EB80AB9DCE99EE4
:1008A000E89C23088EF514AAF5832303F514A7F525
:1008B000E5B499F596D1F853EFD36796C5B85823A8
:1008C0008040A004D1F853E3D32396D1F8F5140067
:1008D000F5832349E3A82301F59400F5F2E0E8D677
:1008E000830000000000000000000000000000085
:1008F000000000000000000000000000000000F8
:10090000 8595F55400F5AFF9AEF8ADFE3752188570
:10091000 23C8E514B6F52402FF52B8B643B84827F9
:10092000A0E5749CF5B858F05380A0F55441F5FF4C
:10093000 7243F51439F527F5D400F5F514D2F5F521
:10094000 5475F5FD37724BF55441F5B957B858F069
:10095000 53059659FF7259246523FC51A1F51439AA
:10096000F5230124CE230141A1FD127032762 47AB1
:10097000 230241A1247A23FD51A1FF9288B848F0B7
:10098000F288E5F4C2F5248CF51439F5FF3792941A
:10099000 230224CEB844B96534A6F6B034A6E68432
:1009A00034A6E6B424B0F9E3AAF0376A3718 1983FD
:1009B000230424CE230824CEB9573772C5FD371230
:1009C000C5231041A123FC51A1E5F4C2F5278AE01B
:1009D0009AEF373FB957F132DD23028583 23FD9E14
:1009E000830000000000000000000000000000084
:1009F000000000000000000000000000000000F7
:100A00008AE09AEF0CAA8AB09ABF0C5301474AD3F6
:100A10000CAAB85BD0C633B814B9DE5 91B8AE09AD9
:100A2000EF0CA98AB09ABF0C53014749D30CDA9650
:100A300000EB19885BFA20A9375AA8FA3759A9FA79
:100A40008327B959A119A1B810FB07724FB9598A6B
:100A5000B09ABF373FBA088B0023F607965B0C7706
:100A6000375301C6661BEA59FB070797526FA7F178
:100A7000F7A1E84983B85527A018A0BB10B404FA1B
:100A800007A8FB07E57402F5D28EF29544AC530F2C
:100A9000A9B852449A5307A98854E514DCF5C6AC7A
:100AA000B855FB07A9E514DCF5F049A0EA7FEB7D1A
:100AB000B855B94EF0A119193 7A1C918F0A11919E3
:100AC00037A1E554DEF5838AD09ADF0CAA0D5303D3
:100AD000474AAAB90AB8DEE8D70CA80D530347481D
:100AE000DA96C7E9D583000000000000000008E
:100AF000000000000000000000000000000000F6
:100B0000E55460F5B2DAE5549EF5B2DAAFB800E527
:100B10007402F5AEB2DAB857F012232301E554CBD4
:100B2000F564DAB855FFA9E514DCF596422303F530
:100B300054CBF58AE09AEF23FB9EE55460F5B2DAD8
:100B4000643A23206FA8F0ADB848F0376D37E65708
:100B5000B85BF0925764DA8AE09AEF23F79E230499
:100B6000E554CBF5F51439F596DAFEF286D27164C8
:100B7000DAFFF5B400F5AC8AE09AEF23028EB8579D
:100B800023FD50A0648CFFE574EFF5AC8AE09AEF8A
:100B9000230 88EB94911FCF2D623036FA82301E57F
```

```
:100F10000000000000000000000000000000000D1
:100F20000000000000000000000000000000000C1
:100F30000000000000000000000000000000000B1
:100F40000000000000000000000000000000000A1
:100F50000000000000000000000000000000000 91
:100F60000000000000000000000000000000000081
:100F70000000000000000000000000000000000071
:100F80000000000000000000000000000000000061
:100F90000000000000000000000000000000000051
:100FA0000000000000000000000000000000000041
:100FB0000000000000000000000000000000000031
:100FC0000000000000000000000000000000000021
:100FD0000000000000000000000000000000000011
:100FE0000000000000000000000000000000000001
:100FF0000000000000000000000000000000000F1
:00000001FF
```

We claim:

1. A beverage dispensing machine operable in a beverage dispensing mode in which a beverage may be selected by a user and at least one machine function mode in which an operator may change machine characteristics and functions, said beverage dispensing machine including a plurality of user selection keys each enabling a user to select a beverage from a range thereof when said machine is in said beverage dispensing mode, a corresponding plurality of first visual display means, one each associated with each user selection key for displaying whether or not a selected beverage is available for dispensation when said machine is in said beverage dispensing mode, and second visual display means for indicating credit functions to a user when said machine is in said beverage dispensing mode, said user selection keys having multiplexed functions so that when said at least one machine function mode is enabled said user selection keys enable an operator to select a beverage for which machine characteristics and functions are to be changed and to change those machine characteristics and functions by using one or more of said user selection keys and wherein at least one of said first and second display means is arranged to display machine states in addition to the beverage availability and credit function states in the beverage selection mode.

2. A machine according to claim 1 when of the "In-Cup" type wherein each first visual display means includes at least one visual indicator which, during the dispensing mode, indicates that the beverage is available for dispensation.

3. A machine according to claim 1 when of the "In-Cup" type wherein each first visual display means includes at least one visual indicator which, during the dispensing mode, indicates that the stack of cups is exhausted.

4. A machine according to claim 1 wherein said user selection keys and said first and second visual display means are on a front panel of said machine, and means are provided for disabling the beverage dispensing mode and for enabling a machine function mode.

5. A machine according to claim 4 wherein said disabling means includes a switch actuated when a door on which said front panel is mounted is opened.

6. A machine according to claim 4 wherein said enabling means includes a further user selection key which, in the beverage dispensing mode, is employed to control a characteristic of a beverage selected, and which, by successive actuation when the machine is in said at least one machine function mode, enables successive function modes to be enabled.

7. A machine according to claim 6 wherein said further user selection key, in the beverage dispensing mode, enables an espresso-type beverage to be selected.

8. A machine according to claim 6 wherein said enabling means includes at least one further key for enabling successive machine function modes to be enabled and which at least one further key has no function during the beverage dispensing mode.

9. A machine according to claim 8 which includes means to enable at least one characteristic of a dispensable beverage to be altered during a machine function mode, said alteration being effected by a first actuation of the appropriate user selection key whereby its associated first display means is energized and an indication of the current value or property of said characteristics is displayed by said first or second display means, whereby said value or property is altered by further actuation of said user selection key with said alteration being indicated by the first or second display means.

10. A machine according to claim 9 wherein said characteristic is a beverage vend price.

11. A machine according to claim 10 wherein, with said first actuation of said user selection key, the current beverage vend price is displayed by the first or second display means, and with said further actuation said price is incremented or decremented.

12. A machine according to claim 9 wherein said characteristic is a water dispensing time.

13. A machine according to claim 12 wherein, with said first actuation of said user selection key, the current water dispensing time is displayed by the first or second display means, and with said further actuation said time is incremented or decremented.

14. A machine according to claim 9 wherein said characteristic is one or more accessory ingredients to be added to the beverage.

15. A machine according to claim 14 wherein, with said first actuation of said user selection key, a code

```
:100BA00034F7F52305E554CBF5B85BF0B81592C6DC
:100BB000B848F0376D375E6B927A0B94996C0B100FB
:100BC000E5749CF5B814FDF534F7F5235AE332D605
:100BD000B857230440A0F55475F58AE09AEF230432
:100BE0008E23088E23018E230F8D630000000000CA
:100BF000000000000000000000000000000000000F5
:100C0000D5B807E53460F5C59611F554C7F5FA92E5
:100C10004C8AE09AEF23FE9D236BE3E514A7F5854C
:100C200095F554C7F5FA379234B6358AE09AEF2332
:100C3000018D844C85E514B3F596218AE09AEF2363
:100C4000018DB858F04301A02380845AFA530FA9AC
:100C5000B852FA5320E53400F5FAD5B807E53478F0
:100C6000F5C593D5B807E53460F5C5BA00B804F802
:100C7000127B8AD09ADF23FE9E84828AD09ADF2359
:100C8000018EB9DFF9840D47F7530197C48FA7FAB5
:100C9000F7AAF86F230AD4969D23018444FAC6C868
:100CA000D30FC6A8230484AA2302D5B807E5347855
:100CB000F5C583B800B9088AD09ADF0D777753015C
:100CC000C6C31823940796C5E9B7F872CF96B383C5
:100CD000000000000000000000000000000000014
:100CE000000000000000000000000000000000004
:100CF000000000000000000000000000000000F4
:100D0000AC2349E3A927F59400F5AAF25837B24F65
:100D1000FA530F4340AAB804FCC8E57402F5DAC6DA
:100D2000261BF818A44FF59463F552261258230BAB
:100D3000F5D400F57238A4581242230 2B85840A0E6
:100D4000A458FCF5B461F527F59400F527A4602 3B9
:100D500001F59400F5AAE90B2364E514B6F52380A8
:100D6000830330A8F05307034AE3ACB857F0373297
:100D700074FC47ACB800FCAA2305E514A7F5F59469
:100D800063F5373289BA00A4A4FBF285B908FAF703
:100D9000AA3712A2235169E3A8FB3760F6A223FE0B
:100DA0005AAAE98EFA474AAA32B38AE09AEF230890
:100DB0006DA4BA8AE09AEF23F79DFA12C223048D1C
:100DC000A4C523FB9DFA52CD23018EA4D023FE9F01
:100DD000FAC6DCE514B3F596D31BA47683000000B5
:100DE000000000000000000000000000000000003
:100DF000000000000000000000000000000000F3
:100E0000BA08960AF594B3F5724A8AE09AEF23FD80
:100E10009DBB04236CE3E514A7F5F59463F512225A
:100E2000C42623014AAAF594B3F52AA953F74AAA7E
:100E3000F9375A7243E514B3F5961AEB132304B845
:100E40005840A08AE09AEF23028DFAB3B857F03712
:100E5000529423FB50A0235AE3AE371262B949F1F2
:100E6000C694B848F0C694F51439F59694B949B1CA
:100E700000B848F0F5D495F5AFF82FB801E534F790
:100E8000F5FE528C272FB802E534F7F5FFB848A0DD
:100E9000E5749CF583A5BA00BD03CD235D6DE3AC77
:100EA00023446DA8F0C6BBFB376C37F6BBABFA6CBE
:100EB000AAF007A0FDF5146AF5C4A01DED9AFBA8E1
:100EC000FA830000000000000000000000000A5
:100ED000000000000000000000000000000000012
:100EE000000000000000000000000000000000002
:100EF000000000000000000000000000000000F2
:100F000000000000000000000000000000000E1
```

corresponding to the current accessory(ies) to be added to the beverage is displayed by the first or second display means, and with said further actuation said code is altered to correspond to and enable a different selection of accessory ingredients to be added to the beverage.

16. A machine according to claim 9 which includes means to enable any faults in the machine to be displayed during a function mode, faults being displayed by energization of one or more of said plurality of second display means.

17. A machine according to claim 16 which includes means to enable more faults to be displayed than there are first display means, said faults being arranged into groups, each group being displayed successively by said first display means, and an indication of the group being displayed being given by said second display means.

18. A machine according to claim 9 which includes means to enable any faults in the machine to be displayed during a function mode, particular faults being displayed by energization of one or more of said first display means.

19. A machine according to claim 18 which includes means to enable more fauls to be displayed than there are first display means, said faults being displayed successively by said first display means.

20. A machine according to claim 9 wherein each said first display means comprises at least one lamp.

21. A machine according to claim 9 wherein each said first display means comprises at least two lamps of different characteristics.

22. A machine according to claim 9 wherein each said first display means comprises an alphanumeric display.

23. A machine according to claim 22 wherein each alphanumeric display comprises one of more seven-segment alphanumeric displays.

24. A machine according to claim 9 wherein the second display means comprises one or more seven-segment alphanumeric displays.

* * * * *